US005592075A

United States Patent [19]

Heining

[11] Patent Number: 5,592,075

[45] Date of Patent: Jan. 7, 1997

[54] CIRCUIT CONFIGURATION FOR SUPPLYING ELECTRICAL CONSUMERS WITH A CONSTANT VOLTAGE

[75] Inventor: Joern Heining, Regensburg, Germany

[73] Assignee: Siemens Aktiengesellschaft, Munich, Germany

[21] Appl. No.: 309,953

[22] Filed: Sep. 21, 1994

[30] Foreign Application Priority Data

Sep. 21, 1993 [EP] European Pat. Off. ..... 93115240

[51] Int. Cl.[6] ..... G05F 3/16

[52] U.S. Cl. ..... 323/313; 323/315

[58] Field of Search ..... 323/312, 313, 323/314, 315, 316

[56] References Cited

U.S. PATENT DOCUMENTS

| | | | |
|---|---|---|---|
| 4,258,310 | 3/1981 | Asakawa et al. | 323/281 |
| 4,591,739 | 5/1986 | Nagano | 323/315 X |
| 4,736,125 | 4/1988 | Yuen | 323/314 |
| 4,740,766 | 4/1988 | Metz | 323/316 |
| 5,373,253 | 12/1994 | Bailey et al. | 323/315 X |

FOREIGN PATENT DOCUMENTS

| | | |
|---|---|---|
| 0477165 | 3/1992 | European Pat. Off. . |
| 0524498 | 1/1993 | European Pat. Off. . |
| 4114073 | 11/1992 | Germany . |

OTHER PUBLICATIONS

Patent Abstracts of Japan, vol. 7, No. 262 (P–238) No. 22, 1983; & JP–58144920 (Tokyo) Aug. 29, 1983.

Book: Sensorik (Sensor Technology) Walter Heywant 3rd Edition, Springer–Verlag 1988, pp. 251–253.

*Primary Examiner*—Peter S. Wong

*Assistant Examiner*—Y. J. Han

*Attorney, Agent, or Firm*—Herbert L. Lerner; Laurence A. Greenberg

[57] ABSTRACT

A circuit configuration for supplying electrical consumers, in particular sensors in a motor vehicle, with a constant voltage required for their operation, includes a reference voltage source. A transistor is connected as an emitter follower for making a buffered reference voltage available at an output as a supply voltage for an electrical consumer.

5 Claims, 1 Drawing Sheet

CIRCUIT CONFIGURATION FOR SUPPLYING ELECTRICAL CONSUMERS WITH A CONSTANT VOLTAGE

BACKGROUND OF THE INVENTION

1. Field of the Invention

The invention relates to a circuit configuration for supplying electrical consumers, in particular sensors in a motor vehicle, with a constant voltage required for their operation.

Such circuit configurations are used in motor vehicles, for instance, in which various control units (for engine control, transmission control, anti-lock and traction control, etc., for instance) cooperate with a great number of sensors. A sensor system with a plurality of external sensors and with digital signal processing for an engine control unit is described in the technical book by Walter Heywang entitled "Sensorik" [Sensor Technology], 3rd Edition, Springer-Verlag, 1988, pp. 252–253.

External sensors often measure ratiometrically. In other words, the ratio between the measurement voltage and the operating voltage is dependent on the measurement variable. The operating voltage for the sensor is made available by the control unit. Since the control unit likewise converts the sensor voltage ratiometrically—the converted measured value is equivalent to the ratio between the measurement voltage and a reference voltage–the sensor operating voltage should be identical to the control unit reference voltage. However, direct derivation of the reference voltage from the control unit for supply to the sensor, while conceivable, is not actually possible, because in automotive engineering, all of the outputs of control units must be protected against short circuits.

With sensor systems known thus far in the industry, every sensor is supplied by a separate voltage controller. The attendant unavoidable difference between the reference voltage of the control unit and the supply voltage of the sensor is expressed as a multiplicative error in the sensor voltage and thus in the outcome of measurement as well.

SUMMARY OF THE INVENTION

It is accordingly an object of the invention to provide a circuit configuration for supplying electrical consumers or loads with a constant voltage, which overcomes the hereinafore-mentioned disadvantages of the heretofore-known devices of this general type and which furnishes a voltage corresponding to a reference voltage of a control unit for supplying external sensors in a way that is secure against short circuits.

With the foregoing and other objects in view there is provided, in accordance with the invention, a circuit configuration for supplying electrical consumers, in particular sensors in a motor vehicle, with a constant voltage required for their operation, comprising a reference voltage source supplying a reference voltage; an output; and a transistor being connected as an emitter follower between the reference voltage source and the output, the transistor making the buffered reference voltage available at the output as a supply voltage for an electrical consumer.

In accordance with another feature of the invention, there is provided a first current source connected to the transistor for supplying the transistor and limiting a short-circuit current through the transistor.

In accordance with a further feature of the invention, there is provided a diode connected to the transistor for compensating for a voltage drop at a base-to-emitter path of the transistor.

In accordance with an added feature of the invention, there is provided a second current source connected to the diode for driving a constant current through the diode.

In accordance with an additional feature of the invention, the diode is another transistor connected as a diode.

In accordance with yet another feature of the invention, there is provided a diode connected between the emitter and the base of the transistor, the diode limiting an emitter-to-base voltage upon a short circuit toward an operating voltage.

In accordance with a concomitant feature of the invention, there is provided at least one other output, the outputs supplying mutually independent output voltages.

Other features which are considered as characteristic for the invention are set forth in the appended claims.

Although the invention is illustrated and described herein as embodied in a circuit configuration for supplying electrical consumers or loads with a constant voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
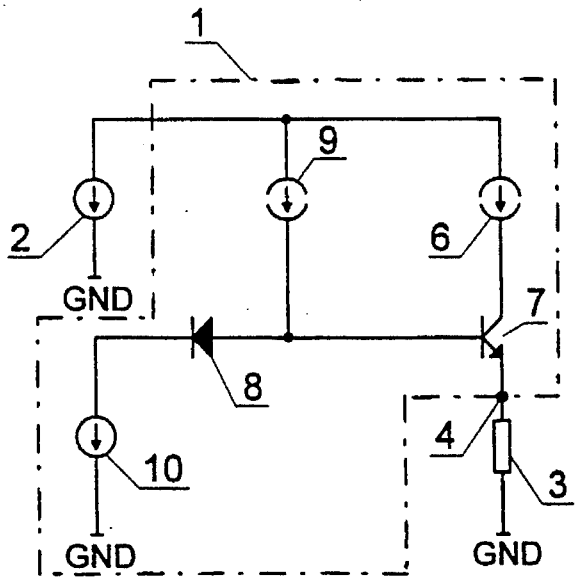
FIG. 1 is a basic schematic circuit diagram of a control unit provided with a circuit configuration according to the invention.

Referring now to the figures of the drawing in detail and first, particularly, to FIG. 1 thereof, there is seen a control unit 1 that is provided with an operating voltage source 2, which in the present case is a battery of a motor vehicle. A load resistor in the form of a sensor 3 is located between an output 4 of the circuit configuration and a ground terminal indicated by reference symbol GND.

Figure 2:
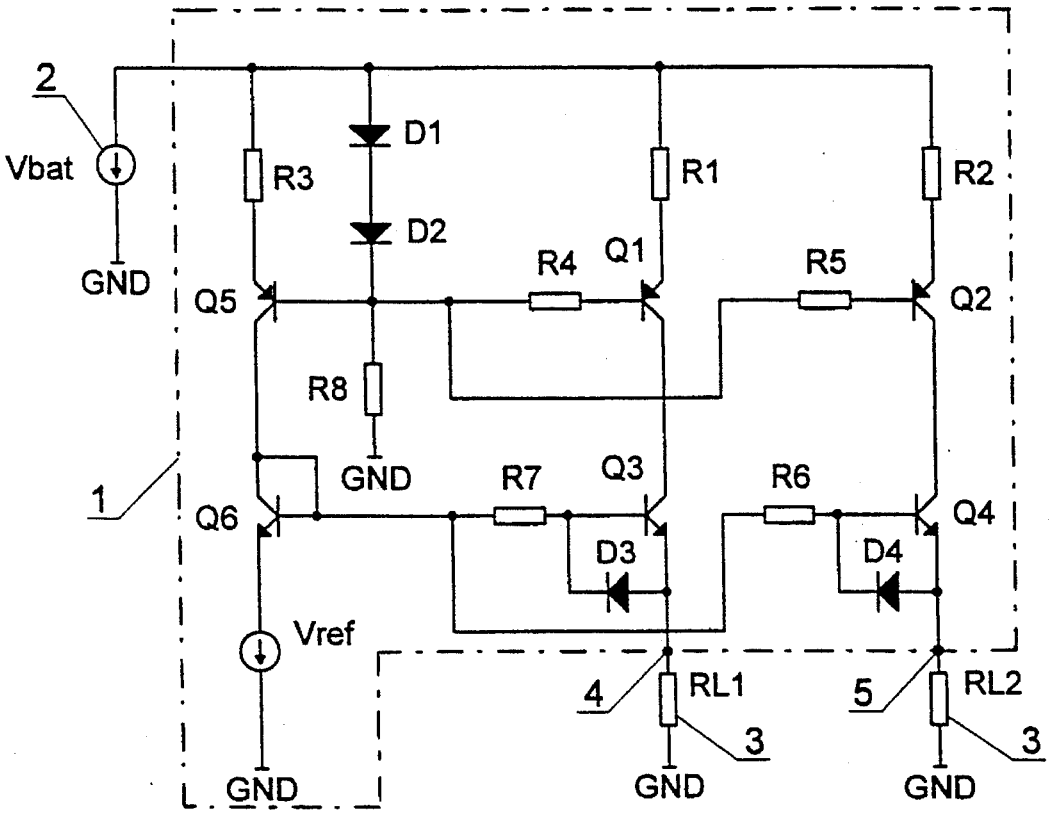
FIG. 2 is a circuit diagram of the circuit configuration of FIG. 1.

A first current source 6 is connected to a collector of a transistor 7 that is connected as an emitter follower. This current source 6 limits any short-circuit current through the sensor 3 to ground. A voltage drop at a base-to-emitter path of the transistor 7 is compensated for by a diode 8. The diode 8 is located between a second or sensor current source 9 and a reference voltage source 10. An operating voltage Vbat of the circuit configuration 1 which is furnished by the operating voltage source 2 as is seen in FIG. 2, must be greater than a reference voltage (Vref) which is furnished by the reference voltage source 10. The second current source 9 drives a constant current through the diode 8 and thus prevents the operating voltage from penetrating or punching through to the supply voltage for the sensor 3.

The reference voltage is buffered by the emitter follower transistor 7 and furnished to the sensor 3 which acts as a load resistor. The term "buffered" means that no current is drawn from the reference voltage source 10, and accordingly that source is not loaded by the load resistor.

No other components of the control unit 1 are described herein, because on one hand they are not touched by the invention and on the other hand they are well known in many versions and described in many printed publications.

Details of the circuit configuration of FIG. 1 may be found in the circuit diagram of FIG. 2. The above-described generation of the supply voltage is utilized multiple times in this case. In the exemplary embodiment, two output voltages are generated for two external sensors or load resistors RL1 and RL2. Two transistors Q1 and Q2 each correspond to the first current source 6 of FIG. 1. The transistors Q1 and Q2 have emitters which are each connected through a respective resistor R1 and R2 to a positive pole of the battery or operating voltage source 2. The transistors Q1 and Q2 have bases each being connected through a respective resistor R4 and R5 to a junction point of a voltage divider formed by two diodes D1 and D2 and one resistor RS. Additionally connected to this junction point is a base of a transistor Q5, which corresponds to the current source 9 of FIG. 1 and has an emitter which is connected through a resistor R3 to the positive pole of the battery.

Two transistors Q3 and Q4, which are connected as emitter followers, as the drawing shows, correspond to the transistor 7 of FIG. 1. The transistors Q3 and Q4 have bases which are each connected through a respective resistor R7 and R6 to a further transistor Q6. The further transistor Q6 is connected as a diode by having its base connected to its collector and is equivalent to the diode 8 of FIG. 1. Greater accuracy in the output voltage of the emitter followers Q3 and Q4 can thus be attained, since when transistors of the same type are used, their base-to-emitter voltages match better than when a normal diode is used.

Diodes D3 and D4, each of which is located between the emitter and the base of a respective one of the transistor Q3 and Q4, protect the transistors Q3 and Q4 against an overly high emitter-to-base voltage, in the event of a short circuit to the operating voltage Vbat. The emitters of the transistors Q3 and Q4 are each connected to a respective one of the load resistors RL1 or RL2 and each form one output 4 and 5 of the circuit configuration, to each of which a voltage identical to the reference voltage Vref of the control unit is made available in short-circuit-proof fashion as a supply or operating voltage for the sensors 3.

The following values and component designations are listed below as an example for dimensions in the circuit diagram of FIG. 2:

| | | |
|---|---|---|
| R1 = 39 Ω | | R5 = 10 kΩ |
| R2 = 39 Ω | | R6 = 2.2 kΩ |
| R3 = 120 Ω | | R7 = 2.2 kΩ |
| R4 = 10 kΩ | | R8 = 22 kΩ |
| RL1 = RL2 = 2 kΩ | | |
| D1 = D2 = D3 = D4 | = diodes of type 1n148 | |
| Q1 = Q2 = Q5 | = transistors Bc807 | |
| Q3 = Q4 = Q6 | = transistors Bc817 | |
| Vbat = 14 V DC | | |
| Vref = 5 V DC | | |

We claim:

1. A circuit configuration for supplying electrical consumers, including sensors in a motor vehicle, with a constant voltage from a voltage source, comprising at least a first series circuit having a first current source, and a first transistor connected as an emitter follower, a second series circuit composed of a second current source, a diode, and a reference voltage source, said second series circuit connected in parallel with the voltage source, and wherein the base of the transistor is connected with the anode of the diode.

2. The circuit configuration according to claim 1, wherein said diode is another transistor connected as a diode.

3. A circuit configuration according to claim 1, wherein said first current source includes at least one second transistor, the emitter of which is connected via a resistor with a positive pole of the voltage source, wherein the collector of said second transistor is connected with said transistor connected as an emitter follower, and wherein the base of said second transistor is connected via a resistor with said second current source.

4. A circuit configuration according to claim 3, wherein said second current source includes a third transistor, the emitter of which is connected via a resistor with the positive pole of the voltage source, and wherein the collector of said third transistor is connected with said diode, and the basis of said third transistor is connected with the dividing point of a voltage divider which is connected with the voltage source.

5. A circuit configuration according to claim 1, wherein said transistor connected as an emitter follower has a diode connected in forward direction from its emitter to its base.

* * * * *